US010950395B2

(12) United States Patent
Strand

(10) Patent No.: US 10,950,395 B2
(45) Date of Patent: Mar. 16, 2021

(54) SWITCHING DEVICE

(71) Applicant: ABB Oy, Helsinki (FI)

(72) Inventor: Fredrik Strand, Vaasa (FI)

(73) Assignee: ABB Oy, Helsinki (FI)

( * ) Notice: Subject to any disclaimer, the term of this patent is extended or adjusted under 35 U.S.C. 154(b) by 0 days.

(21) Appl. No.: 16/386,674

(22) Filed: Apr. 17, 2019

(65) Prior Publication Data

US 2019/0326082 A1 Oct. 24, 2019

(30) Foreign Application Priority Data

Apr. 24, 2018 (EP) ..... 18168981

(51) Int. Cl.
*H01H 19/24* (2006.01)

(52) U.S. Cl.
CPC ..... *H01H 19/24* (2013.01); *H01H 2235/01* (2013.01)

(58) Field of Classification Search
CPC ..... H01H 19/24; H01H 2235/01
USPC ..... 200/401
See application file for complete search history.

(56) References Cited

U.S. PATENT DOCUMENTS

2007/0131528 A1* 6/2007 Mattlar ..... H01H 19/24 200/50.21
2011/0147185 A1* 6/2011 Soininen ..... H01H 71/128 200/336

FOREIGN PATENT DOCUMENTS

| | | | |
|---|---|---|---|
| CN | 103594258 | A | 2/2014 |
| EP | 2099044 | A2 | 9/2009 |
| EP | 2099044 | A3 | 1/2011 |
| EP | 1719142 | B1 | 8/2012 |
| WO | 2009153395 | A1 | 12/2009 |
| WO | 2018024531 | A1 | 2/2018 |

OTHER PUBLICATIONS

European Patent Office, Extended Search Report issued in corresponding Application No. 18168981.1, dated Nov. 7, 2018, 5 pp.

* cited by examiner

*Primary Examiner* — Edwin A. Leon
*Assistant Examiner* — Iman Malakooti
(74) *Attorney, Agent, or Firm* — Taft Stettinius & Hollister LLP

(57) ABSTRACT

A switching device including a frame, a roll element, a control shaft, a drive system and a roll spring. The control shaft is adapted to control rotation of the roll element such that rotating the control shaft from an ON-position to an OFF-position carries out an opening event in which the roll element transfers from a first position to a second position. The drive system includes an actuator and an actuator spring. The drive system is adapted to rotate the roll element during the opening event to an intermediate position located between the first position and the second position. The roll spring is connected between the frame and the roll element, and is adapted to rotate the roll element to the second position during the opening event.

11 Claims, 10 Drawing Sheets

SWITCHING DEVICE

FIELD OF THE INVENTION

The present invention relates to a switching device.

An example of a known switching device is described in publication EP1719142.

One of the problems associated with the above mentioned known switching device is that a clearance angle between positions of a roll element corresponding to an ON-state and an OFF-state of switch contacts is relatively small, approximately 45°.

BRIEF DESCRIPTION OF THE INVENTION

An object of the present invention is to provide a switching device so as to solve the above problem. The objects of the invention are achieved by a switching device which is characterized by what is stated in the independent claim. The preferred embodiments of the invention are disclosed in the dependent claims.

The invention is based on the idea of providing a switching device with at least one roll spring connected between a frame of the switching device and a roll element of the switching device, the at least one roll spring being adapted to rotate the roll element further from the position corresponding to the ON-state during an opening event. The roll element of the switching device according to the present invention is adapted to be rotated during an opening event first with at least one actuator spring operationally connected to the roll element through an actuator, and subsequently with the at least one roll spring connected between the frame and the roll element.

An advantage of the switching device of the invention is that there is a large clearance angle between positions of the roll element corresponding to an ON-state and an OFF-state of switch contacts. Due to the large clearance angle, the present invention enables reducing size of a switching device assembly. The large clearance angle provides adequate clearance between open switch contacts with smaller physical dimensions than a small clearance angle.

BRIEF DESCRIPTION OF THE DRAWINGS

In the following the invention will be described in greater detail by means of preferred embodiments with reference to the attached drawings, in which.

DETAILED DESCRIPTION OF THE INVENTION

Figure 1:
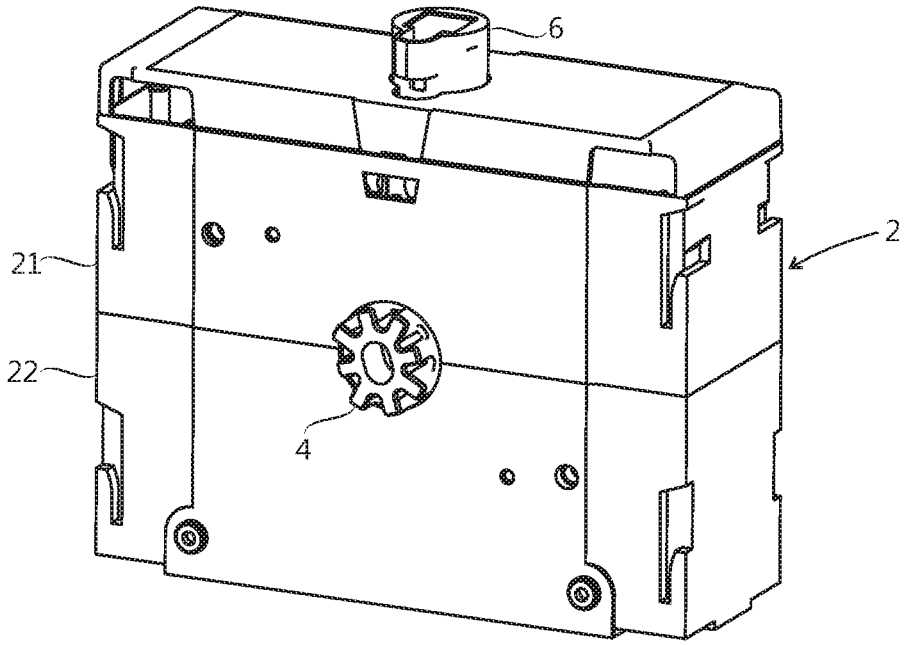
FIG. 1 shows a switching device according to an embodiment of the invention.

FIG. 1 shows a switching device comprising a frame 2, a roll element 4 rotatable between a first position and a second position relative to the frame 2, a control shaft 6 rotatable between an ON-position and an OFF-position relative to the frame 2, and a drive system. The roll element 4 is adapted to transfer from the first position to the second position in an opening event for transferring a switch contact system from an ON-state to an OFF-state. The control shaft 6 is adapted to control rotation of the roll element 4 such that rotating the control shaft 6 from the ON-position to the OFF-position carries out the opening event. The drive system operationally connects the control shaft 6 to the roll element 4 for rotating the roll element 4. The control shaft 6 extends through an upper part 21 of the frame 2, and is adapted to be rotated by a user. The control shaft 6 is adapted to be connected to an operating handle (not shown) which is adapted to be operated by the user.

Figure 2:
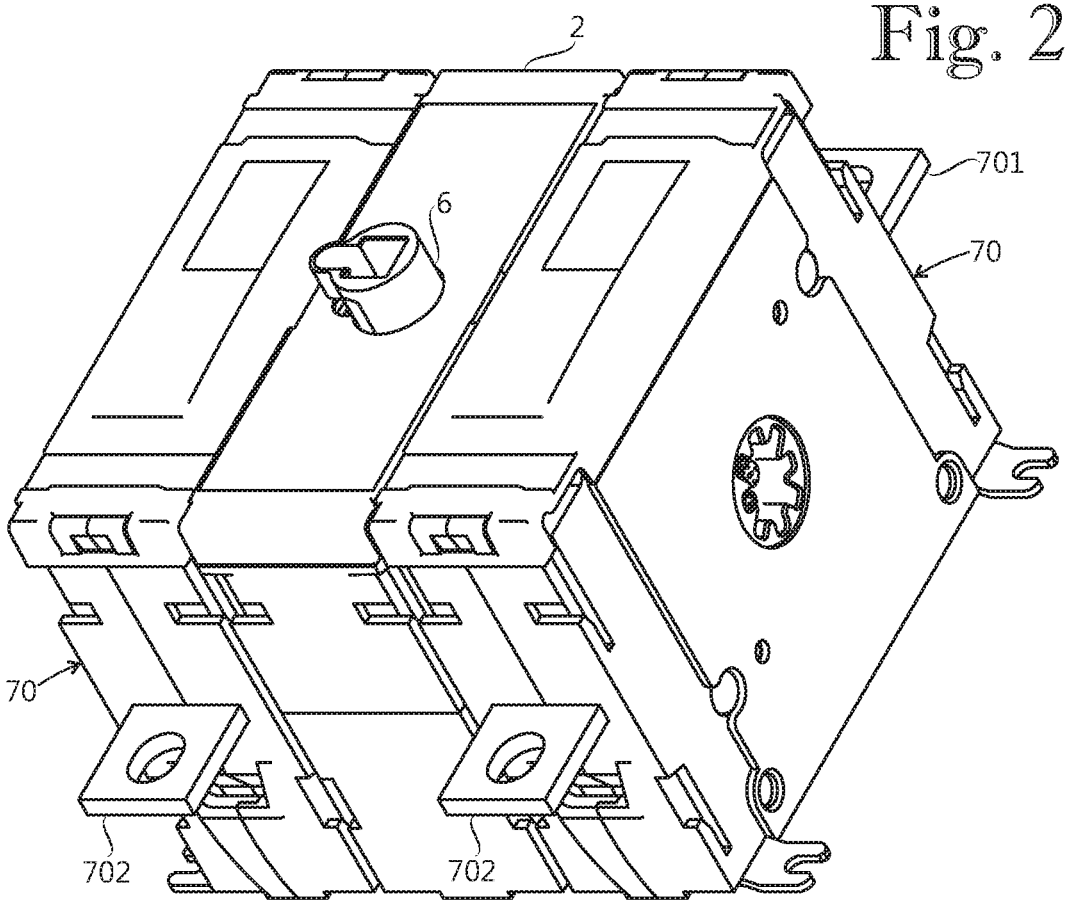
FIG. 2 shows a switching device assembly comprising the switching device of FIG. 1 and two pole modules.

FIG. 2 shows a switching device assembly comprising the switching device of FIG. 1 and two pole modules 70. A switch contact system of the switching device assembly is located in the pole modules 70.

Figure 3:
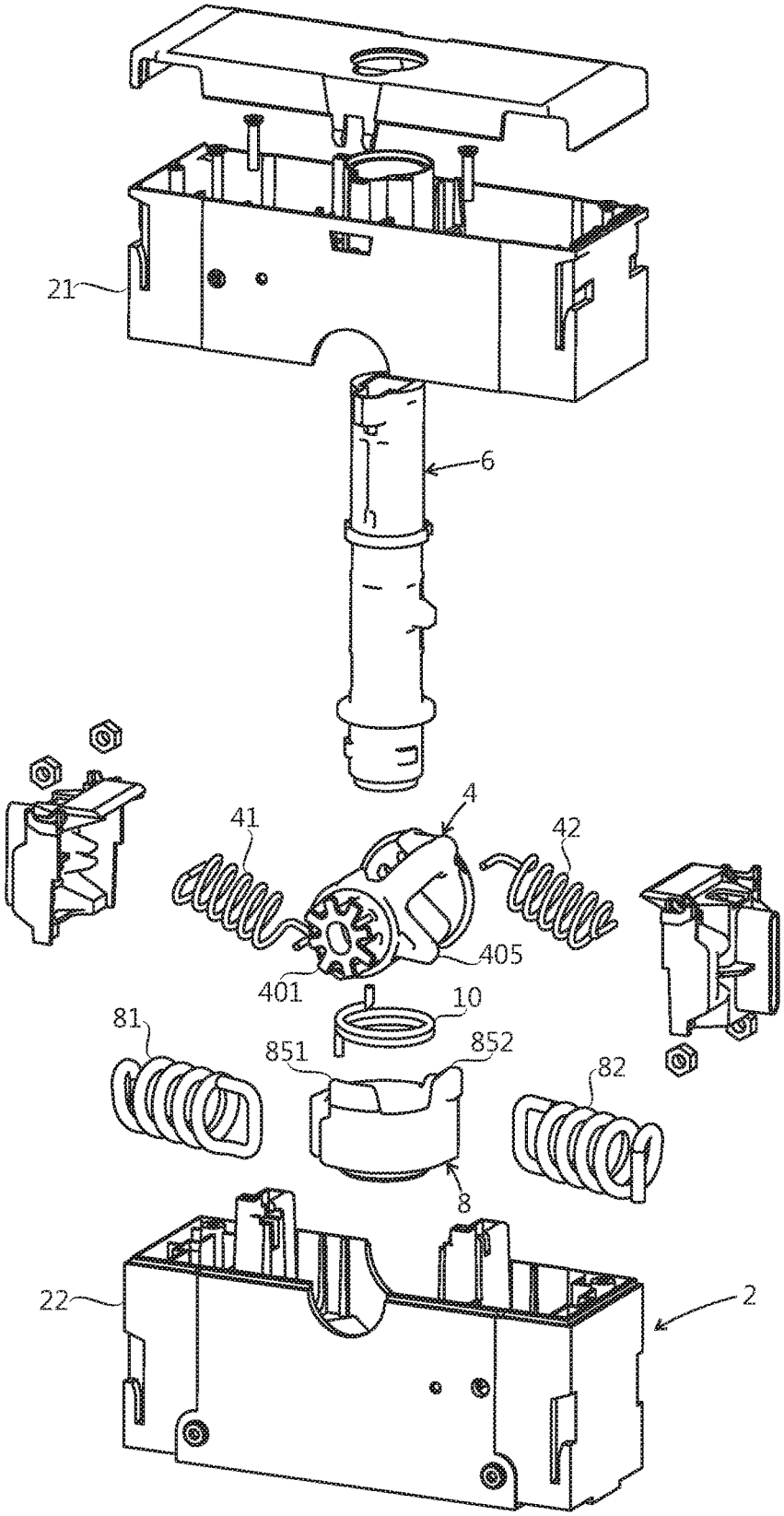
FIG. 3 shows an exploded view of the switching device of FIG. 1 from one direction.
Figure 4:
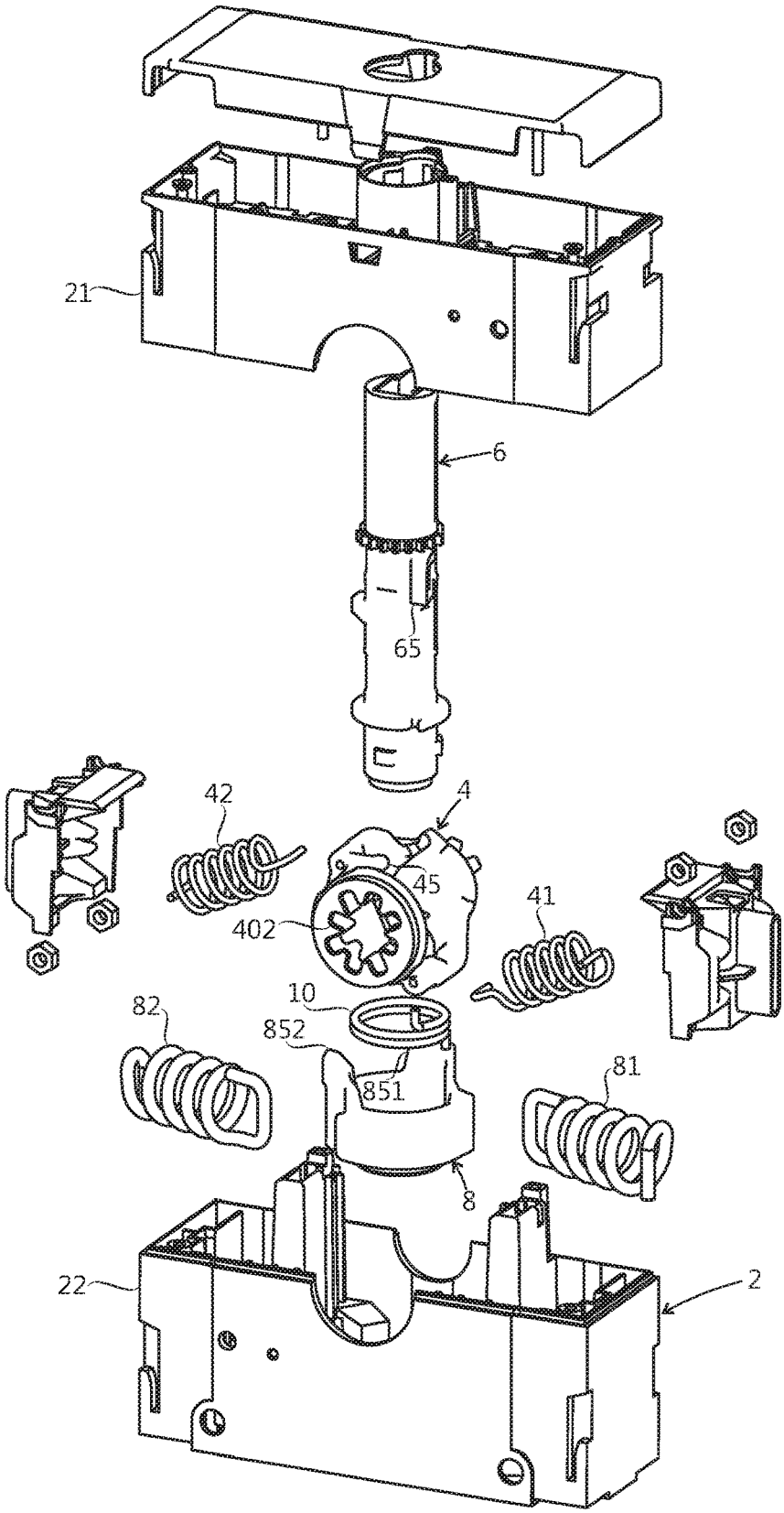
FIG. 4 shows an exploded view of the switching device of FIG. 1 from another direction.

FIG. 3 shows an exploded view of the switching device of FIG. 1 from one direction, and FIG. 4 shows the exploded view from another direction. The exploded views show that the drive system comprises an actuator 8, two actuator springs 81 and 82, two roll springs 41 and 42, a shaft cam 65, a roll cam 45 and a free motion spring 10.

Each of the actuator springs 81 and 82 is a coils spring. Each of the actuator springs 81 and 82 is connected between the frame 2 and the actuator 8, and has a first low energy position, a second low energy position, and a dead-centre position located between the low energy positions. A spring constant of each of the actuator springs 81 and 82 is high. Each of the actuator springs 81 and 82 is adapted to be transferred both from the first low energy position to the dead-centre position and from the second low energy position to the dead-centre position by means of rotation of the control shaft 6 such that energy required for transferring the actuator springs 81 and 82 to the dead-centre position originates from the rotation of the control shaft 6.

Each of the actuator springs 81 and 82 is adapted to transfer from the dead-centre position to the first low energy position in a first actuator trip event. The drive system is adapted to rotate the roll element 4 towards the second position during the opening event by means of energy delivered by the first actuator trip event.

The actuator 8 is adapted to be rotated around an axis of rotation relative to the frame 2, and to co-operate with the roll element 4 for rotating the roll element 4 towards the second position during the opening event. The actuator 8 and the actuator springs 81 and 82 are located in a lower part 22 of the frame 2. The actuator 8 comprises a first actuator protrusion 851 and a second actuator protrusion 852 which are adapted to co-operate with a roll protrusion 405 provided on the roll element 4 for transferring torque from the actuator 8 to the roll element 4. The drive system is adapted to rotate the roll element 4 during the opening event to an intermediate position located between the first position and the second position by means of a mechanical contact between the first actuator protrusion 851 and the roll protrusion 405.

The roll element 4 is provided with a connection system comprising a first connection member 401 on one axial end of the roll element 4, and a second connection member 402 on the other axial end of the roll element 4. Each of the connection members 401 and 402 is adapted to connect the roll element 4 to a roll element of a corresponding pole module 70. In other words the roll element 4 is adapted to be connected to a switch contact system by means of the connection system for transferring the switch contact system between an ON-state and an OFF-state.

A rotation axis of the control shaft 6 is perpendicular to a rotation axis of the roll element 4. A rotation axis of the actuator 8 coincides with the rotation axis of the control shaft 6. The control shaft 6 extends through the roll element 4.

Each of the roll springs 41 and 42 is a coil spring. Each of the roll springs 41 and 42 has a first low energy position, a second low energy position, and a dead-centre position located between the low energy positions. Each of the roll springs 41 and 42 is adapted to transfer from the dead-centre position to the first low energy position in a first roll trip event. The roll springs 41 and 42 are adapted to rotate the roll element 4 to the second position during the opening event by means of energy delivered by the first roll trip event. A spring constant of each of the roll springs 41 and 42 is selected such that a torque adapted to be provided by the roll springs 41 and 42 to the roll element 4 is smaller than a torque adapted to be provided by the actuator springs 81 and 82 to the roll element 4 through the actuator 8.

The shaft cam 65 protrudes from the control shaft 6. The roll cam 45 protrudes from the roll element 4.

The roll element 4 is adapted to transfer from the second position to the first position in a closing event for transferring a switch contact system from the OFF-state to the ON-state. The shaft cam 65 is adapted to co-operate with the roll cam 45 during the closing event for rotating the roll element 4 from the second position towards the first position. The drive system is adapted such that during the closing event rotation of the control shaft 6 towards the ON-position first starts to rotate the roll element 4 towards the first position by means of co-operation between the shaft cam 65 and the roll cam 45, and later starts to rotate the actuator 8 by means of a mechanical contact between the control shaft 6 and the actuator 8.

Each of the actuator springs 81 and 82 is adapted to transfer from the dead-centre position to the second low energy position in a second actuator trip event. The drive system is adapted to rotate the roll element 4 towards the first position during the closing event by means of energy delivered by the second actuator trip event.

The control shaft 6 is connected to the actuator 8 through the free motion spring 10 such that the control shaft 6 is rotatable relative to the actuator 8 between a rest position in which the free motion spring 10 is in a low energy position, and an engagement position in which the free motion spring 10 is in a tensioned position. The free motion spring 10 is adapted to attempt to transfer the control shaft 6 to the rest position if the control shaft 6 is deflected therefrom.

A spring constant of the free motion spring 10 is low. A torque adapted to be provided by the actuator springs 81 and 82 to the actuator 8 is multiple compared to a torque adapted to be provided by the free motion spring 10 between the control shaft and the actuator 8.

Figure 5:
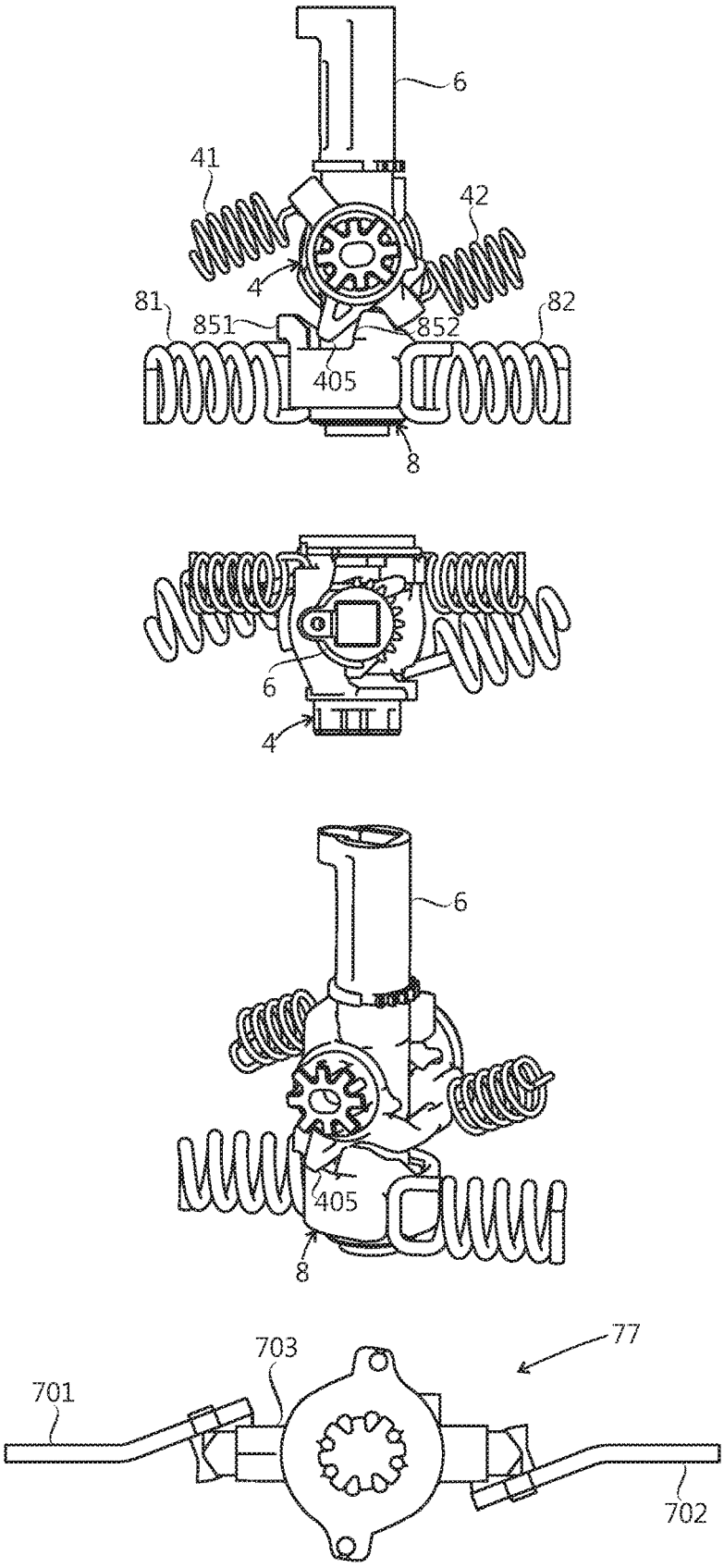
FIG. 5 shows a mechanism of the switching device of FIG. 1 in a starting position of an opening event which is also an end position of a closing event.
Figure 6:
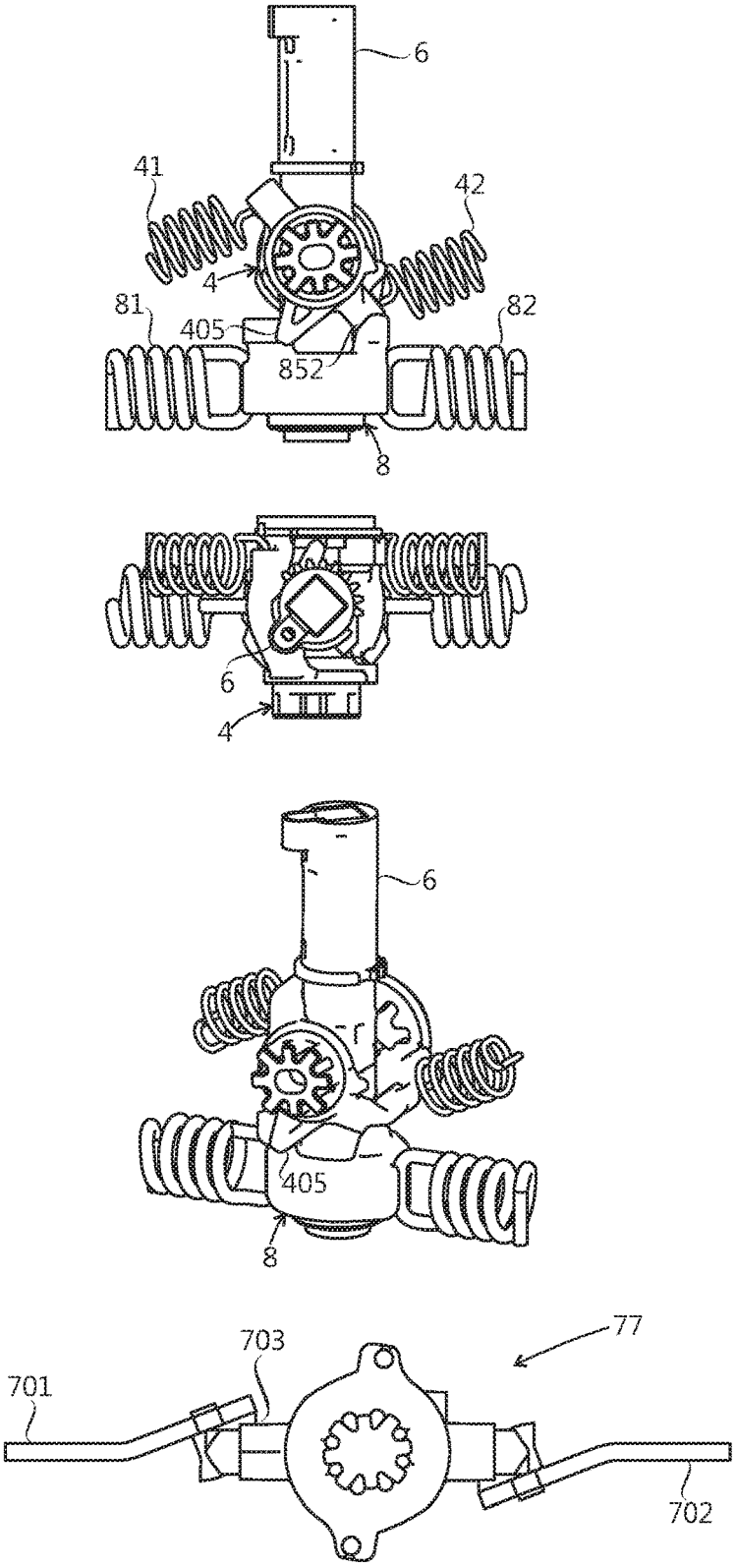
FIGS. 6 to 8 show the mechanism of the switching device of FIG. 1 during the opening event, in different positions between the starting position and an end position of the opening event.
Figure 7:
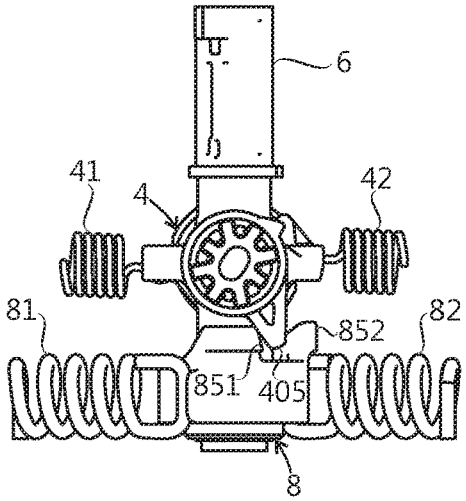
Figure 7:
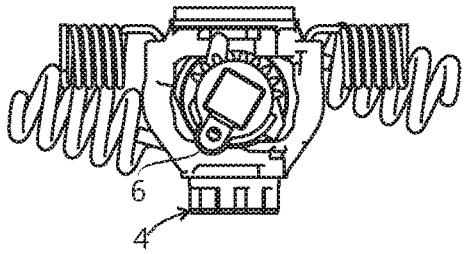
Figure 7:
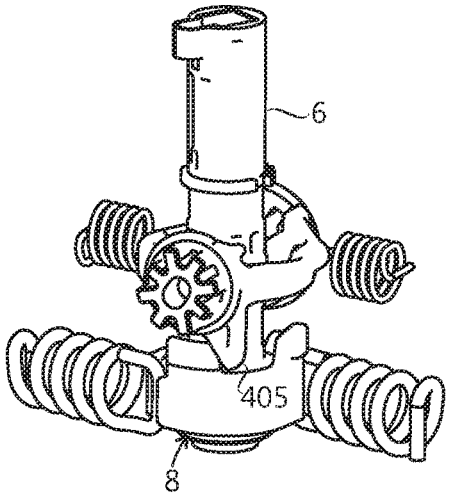
Figure 7:
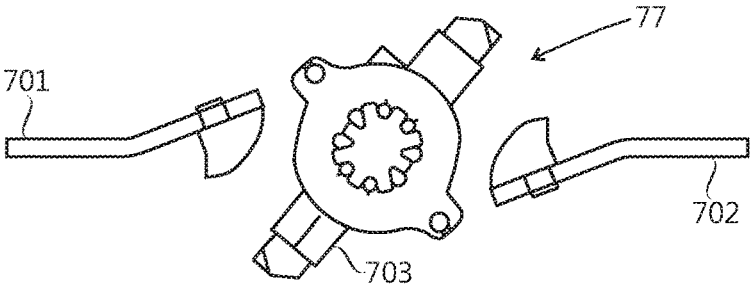
Figure 8:
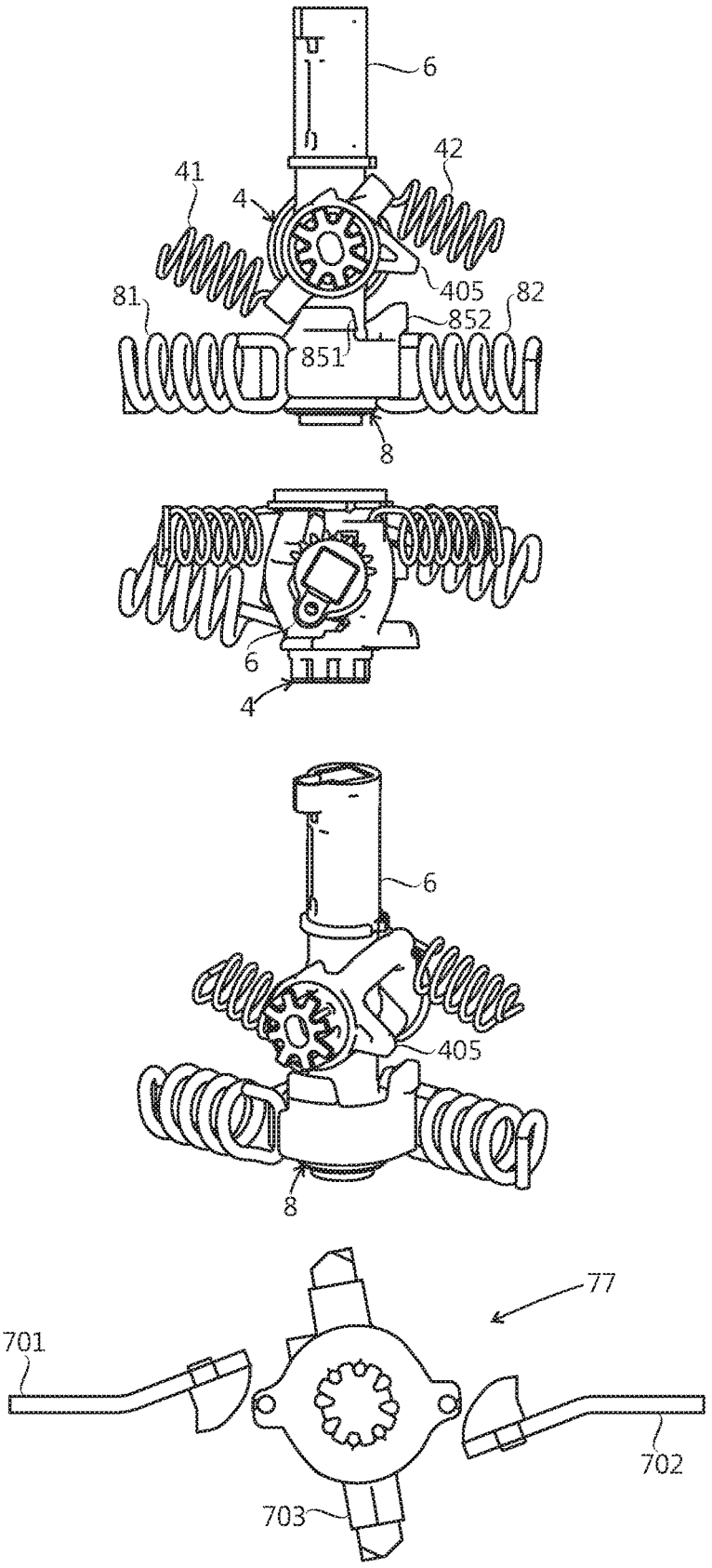
Figure 9:
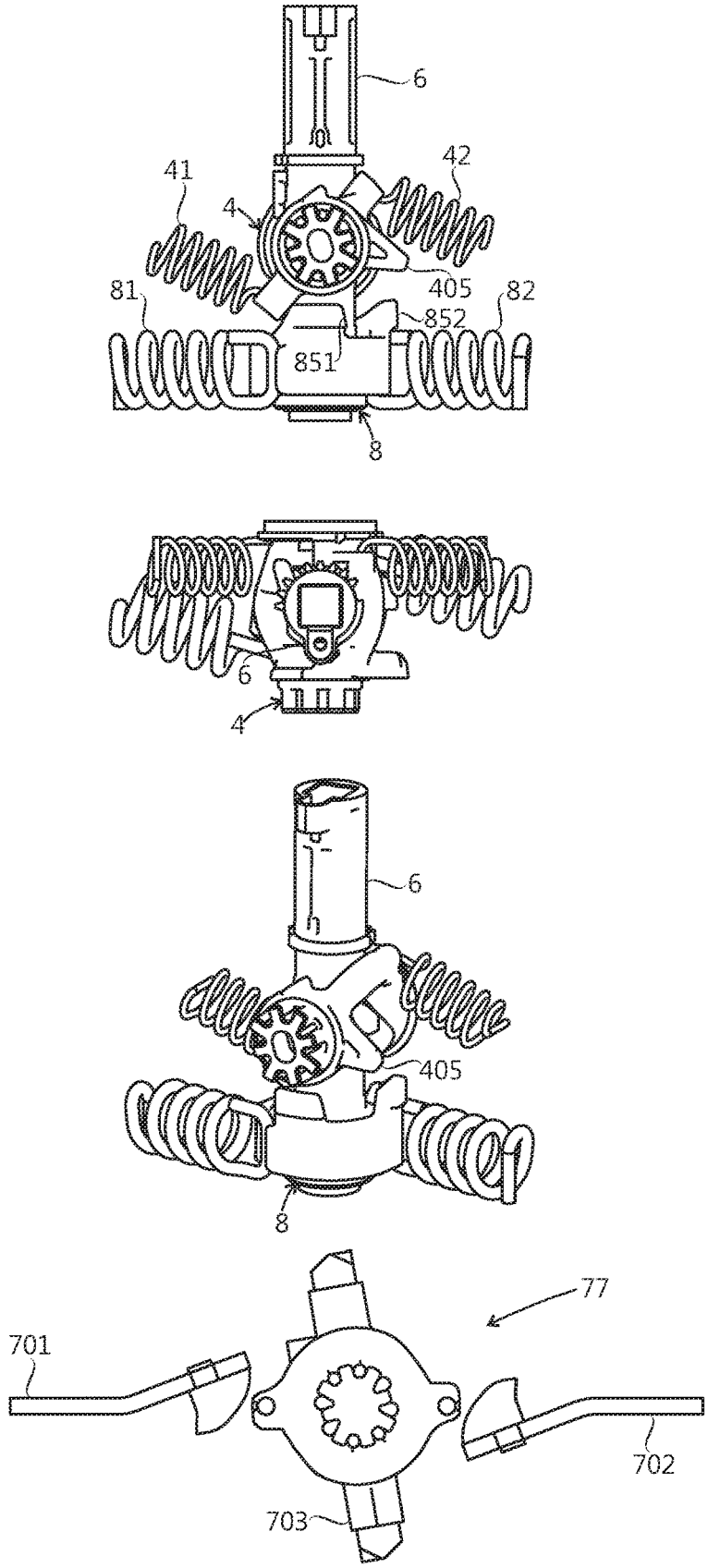
FIG. 9 shows the mechanism of the switching device of FIG. 1 in the end position of an opening event which is also a starting position of the closing event.

FIGS. 5 to 9 show a mechanism of the switching device of FIG. 1 in different stages of an opening event. FIG. 5 shows the mechanism in a starting position of the opening event. FIGS. 6 to 8 show the mechanism in different positions between the starting position and an end position of the opening event. FIG. 9 shows the mechanism in the end position of the opening event. In addition to the mechanism itself, FIGS. 5 to 9 show positions of a switch contact system 77 connected to the roll element 4 of the mechanism.

In FIG. 5 the control shaft 6 is in the ON-position located 90° clockwise relative to the OFF-position which is considered as a reference position herein. The roll element 4 is held in the first position by the roll springs 41 and 42. The roll springs 41 and 42 are in the second low energy position. The actuator springs 81 and 82 are in the second low energy position. The free motion spring 10 is in the low energy position. The switch contact system 77 is in the ON-state in which a rotatable contact member 703 electrically conductively connects a first stationary contact member 701 to a second stationary contact member 702.

In FIG. 6 the control shaft 6 has been rotated counter-clockwise to a 45° position relative to the OFF-position. The control shaft 6 has rotated the actuator 8 to a position in which the actuator springs 81 and 82 are in their dead-centre position in which they store more energy than in the second low energy position. The first actuator protrusion 851 has reached a contact with the roll protrusion 405. The roll element 4 and the switch contact system 77 are in the same position as in FIG. 5.

In FIG. 7 the control shaft 6 has been rotated counter-clockwise to a 30° position relative to the OFF-position. After the control shaft 6 has passed the 45° position, the actuator springs 81 and 82 have transferred from the dead-centre position to the first low energy position in the first actuator trip event, and the actuator 8 has rotated the roll element 4 towards the second position to the intermediate position by means of contact between the first actuator protrusion 851 and the roll protrusion 405. The actuator 8 has stopped rotating. The roll springs 41 and 42 have reached their dead-centre position. The free motion spring 10 is in a position close to the tensioned position, and the control shaft 6 is in a position close to the engagement position relative to the actuator 8.

There is friction in the switch contact system 77 between the first stationary contact member 701 and the rotatable contact member 703, and between the second stationary contact member 702 and the rotatable contact member 703. High spring constants of the actuator springs 81 and 82 ensure that the friction is overcome and the first actuator trip event is capable of rotating the roll element 4 away from the first position. Further, the high spring constants of the actuator springs 81 and 82 ensure that an angular velocity of the roll element 4 is sufficiently high during the opening event in order to keep duration of an electric arc in the switch contact system 77 adequately short.

In FIG. 8 the control shaft 6 is still in the 30° position. The roll element 4 has passed the intermediate position thereof by means of its inertia, and the roll springs 41 and 42 have transferred from the dead-centre position to the first low energy position in the first roll trip event, thereby rotating the roll element 4 to the second position by means of energy delivered by the first roll trip event. The switch contact system 77 is in the OFF-state in which there is a first clearance between the first stationary contact member 701 and the rotatable contact member 703, and a second clearance between the second stationary contact member 702 and the rotatable contact member 703. The free motion spring 10 is still in the position close to the tensioned position, and the control shaft 6 is still in the position close to the engagement position.

In FIG. 9 the free motion spring 10 has transferred to the low energy position thereby rotating the control shaft 6 to the OFF-position relative to the frame 2, wherein the control shaft 6 is in the rest position relative to the actuator 8. Except for the free motion spring 10 and the control shaft 6, components are in the same position as in FIG. 8.

In the mechanism shown in FIGS. 5 to 9, the second position of the roll element 4 is located at a 100° angle relative to the first position of the roll element 4. In an alternative embodiment a clearance angle between the first position and the second position is greater than or equal to 65°.

The intermediate position of the roll element 4 is located at a 50° angle relative to the second position of the roll element 4. In an alternative embodiment an intermediate angle between the intermediate position and the second position is greater than or equal to 20°.

Figure 10:
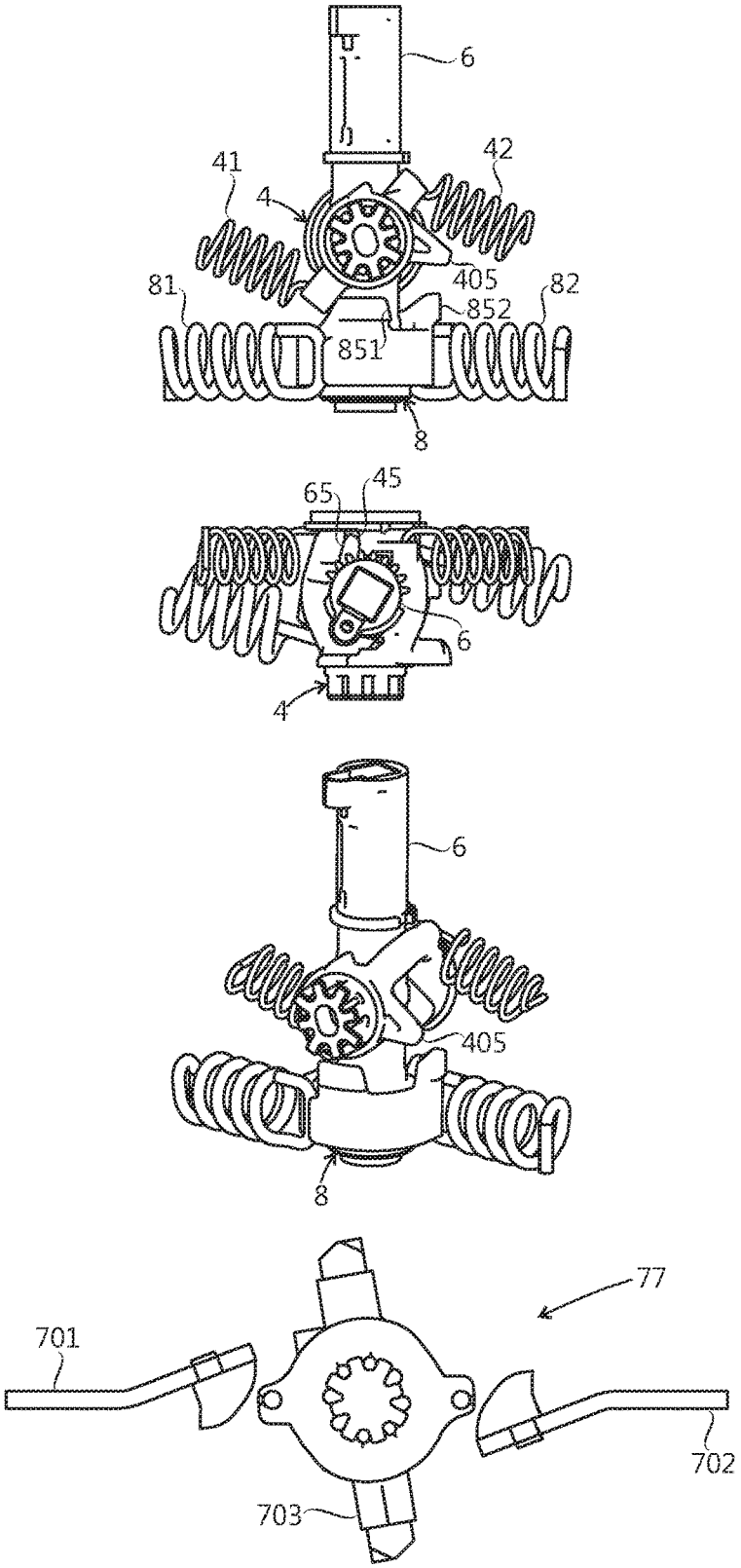
FIGS. 10 and 11 show the mechanism of the switching device of FIG. 1 during the closing event, in different positions between the starting position and the end position of the closing event.
Figure 11:
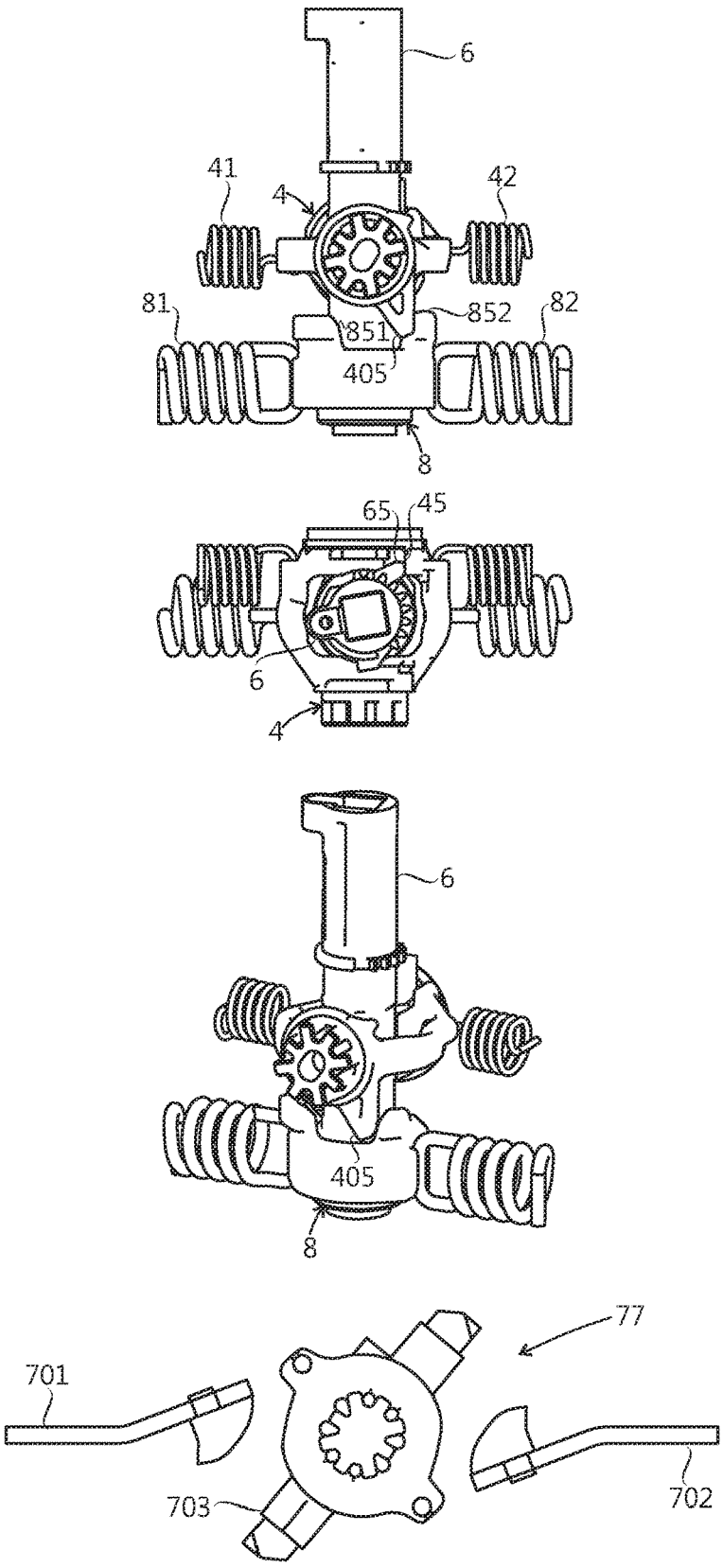

In the starting position of the closing event the mechanism is in the position shown in FIG. 9 and described above. FIGS. 10 and 11 show the mechanism in different positions between the starting position and an end position of the closing event. In addition to the mechanism itself, FIGS. 10 and 11 show positions of the switch contact system 77 connected to the roll element 4 of the mechanism. In the end position of the closing event the mechanism is in the position shown in FIG. 5 and described above.

In FIG. 10 the control shaft 6 has been rotated clockwise to a 35° position relative to the OFF-position. The free motion spring 10 is in the tensioned position, and the control shaft 6 is in the engagement position relative to the actuator 8. At the 35° position the shaft cam 65 has contacted the roll cam 45, and begun to rotate the roll element 4 through the roll cam 45. Therefore the roll element is in a position close to the second position, and the switch contact system 77 is close to the OFF-state. The roll springs 41 and 42 are close to the first low energy position. The actuator 8 has not moved and therefore the actuator springs 81 and 82 are in the first low energy position.

In FIG. 11 the control shaft 6 is in an 80° position. The actuator 8 has rotated 45° by means of a mechanical contact between the control shaft 6 and the actuator 8. The actuator springs 81 and 82 are in their dead-centre position. The roll springs 41 and 42 are close to their dead-centre position. The free motion spring 10 is in the tensioned position, and the control shaft 6 is in the engagement position relative to the actuator 8. The second actuator protrusion 852 is almost in a contact with the roll protrusion 405. The roll element 4 is in a 50° angle relative to the second position, and therefore the switch contact system 77 is halfway between the OFF-state and the ON-state. The shaft cam 65 is still in contact with the roll cam 45.

From the starting position of the closing event to the position of FIG. 11, an angle velocity of the roll element 4 has been user dependent. In other words the user has been able to decide the angle velocity of the roll element 4 from the second position towards the first position.

If the user releases the control shaft 6 in the position of FIG. 11, the mechanism returns to the position of FIG. 9. This return is initiated with energy supplied by the roll springs 41 and 42.

Between positions shown in FIGS. 11 and 5, the control shaft 6 has rotated from the 80° position to the 90° position. When the control shaft 6 is rotated over the 80° position clockwise, the second actuator trip event begins, and the roll element 4 is started to be rotated towards the first position by means of energy delivered by the second actuator trip event. During the second actuator trip event the roll element 4 is rotated by the contact between the second actuator protrusion 852 and the roll protrusion 405.

After the second actuator trip event has begun, rotation of the roll element 4 is completely independent from the user. This user independent movement comprises the last 50° of the rotation of the roll element 4 towards the first position. An angle velocity of the roll element 4 during the last 50° of the rotation towards the first position is high and depends on the actuator springs 81 and 82 and the roll springs 41 and 42.

It will be obvious to a person skilled in the art that the inventive concept can be implemented in various ways. The invention and its embodiments are not limited to the examples described above but may vary within the scope of the claims.

The invention claimed is:

1. A switching device comprising:

a frame;

a roll element rotatable between a first position and a second position relative to the frame, the roll element being adapted to transfer from the first position to the second position in an opening event for transferring a switch contact system from an ON-state to an OFF-state;

a control shaft rotatable between an ON-position and an OFF-position relative to the frame, the control shaft being adapted to control rotation of the roll element such that rotating the control shaft from the ON-position to the OFF-position carries out the opening event;

a drive system operationally connecting the control shaft to the roll element for rotating the roll element, the drive system comprising an actuator and at least one actuator spring connected between the frame and the actuator, the actuator being adapted to be rotated around an axis of rotation, and to co-operate with the roll element for rotating the roll element towards the second position during the opening event, the at least one actuator spring has a dead-centre position and a first low energy position, the at least one actuator spring being adapted to transfer from the dead-centre position to the first low energy position in a first actuator trip event, the drive system being adapted to rotate the roll element towards the second position during the opening event by means of energy delivered by the first actuator trip event, wherein the drive system is adapted to rotate the roll element during the opening event to an intermediate position located between the first position and the second position, and the switching device further comprises at least one roll spring connected between the frame and the roll element, the at least one roll spring being adapted to rotate the roll element to the second position during the opening event, wherein the roll element is adapted to be rotated during the opening event first with the at least one actuator spring operationally connected to the roll element through the actuator, and subsequently with the at least one roll spring.

2. The switching device according to claim 1, wherein the drive system is adapted to rotate the roll element during the opening event to the intermediate position by means of a mechanical contact between the actuator and the roll element.

3. The switching device according to claim 1, wherein there is a clearance angle between the first position and the second position of the roll element, the clearance angle being greater than or equal to 65°.

4. The switching device according to claim 2, wherein there is an intermediate angle between the intermediate position and the second position, the intermediate angle being greater than or equal to 20°.

5. The switching device according to claim 1, wherein the at least one roll spring has a dead-centre position and a first low energy position, the at least one roll spring being adapted to transfer from the dead-centre position to the first low energy position in a first roll trip event, the at least one roll spring being adapted to rotate the roll element to the second position during the opening event by means of energy delivered by the first roll trip event.

6. A switching device comprising:

a frame;

a roll element rotatable between a first position and a second position relative to the frame, the roll element being adapted to transfer from the first position to the second position in an opening event for transferring a switch contact system from an ON-state to an OFF-state;

a control shaft rotatable between an ON-position and an OFF-position relative to the frame, the control shaft being adapted to control rotation of the roll element such that rotating the control shaft from the ON-position to the OFF-position carries out the opening event;

a drive system operationally connecting the control shaft to the roll element for rotating the roll element, the drive system comprising an actuator and at least one actuator spring connected between the frame and the actuator, the actuator being adapted to be rotated around an axis of rotation, and to co-operate with the roll element for rotating the roll element towards the second position during the opening event, the at least one actuator spring has a dead-centre position and a first low energy position, the at least one actuator spring being adapted to transfer from the dead-centre position to the first low energy position in a first actuator trip event, the drive system being adapted to rotate the roll element towards the second position during the opening event by means of energy delivered by the first actuator trip event, wherein the drive system is adapted to rotate the roll element during the opening event to an intermediate position located between the first position and the second position, and the switching device further comprises at least one roll spring connected between the frame and the roll element, the at least one roll spring being adapted to rotate the roll element to the second position during the opening event, wherein a rotation axis of the control shaft is perpendicular to a rotation axis of the roll element, and a rotation axis of the actuator coincides with the rotation axis of the control shaft, and wherein the roll element is adapted to transfer from the second position to the first position in a closing event for transferring the switch contact system from the OFF-state to the ON-state, and the drive system comprises a shaft cam protruding from the control shaft, and a roll cam protruding from the roll element, the shaft cam being adapted to co-operate with the roll cam during the closing event for rotating the roll element from the second position towards the intermediate position.

7. The switching device according to claim 6, wherein the control shaft extends through the roll element.

8. The switching device according to claim 6, wherein the at least one actuator spring has a second low energy position, and the at least one actuator spring is adapted to transfer from the dead-centre position to the second low energy position in a second actuator trip event, the drive system being adapted to rotate the roll element towards the first position during the closing event by means of energy delivered by the second actuator trip event.

9. The switching device according to claim 8, wherein the drive system is adapted such that during the closing event rotation of the control shaft towards the ON-position first starts to rotate the roll element towards the intermediate position, and later starts to rotate the actuator by means of a mechanical contact between the control shaft and the actuator.

10. The switching device according to claim 8, wherein the at least one actuator spring is adapted to be transferred both from the first low energy position to the dead-centre position and from the second low energy position to the dead-centre position by means of rotation of the control shaft such that energy required for transferring the at least one actuator spring to the dead-centre position originates from the rotation of the control shaft.

11. A switching device comprising:

a frame;

a roll element rotatable between a first position and a second position relative to the frame, the roll element being adapted to transfer from the first position to the second position in an opening event for transferring a switch contact system from an ON-state to an OFF-state;

a control shaft rotatable between an ON-position and an OFF-position relative to the frame, the control shaft being adapted to control rotation of the roll element such that rotating the control shaft from the ON-position to the OFF-position carries out the opening event;

a drive system operationally connecting the control shaft to the roll element for rotating the roll element, the drive system comprising an actuator and at least one actuator spring connected between the frame and the actuator, the actuator being adapted to be rotated around an axis of rotation, and to co-operate with the roll element for rotating the roll element towards the second position during the opening event, the at least one actuator spring has a dead-centre position and a first low energy position, the at least one actuator spring being adapted to transfer from the dead-centre position to the first low energy position in a first actuator trip event, the drive system being adapted to rotate the roll element towards the second position during the opening event by means of energy delivered by the first actuator trip event, wherein the drive system is adapted to rotate the roll element during the opening event to an intermediate position located between the first position and the second position, and the switching device further comprises at least one roll spring connected between the frame and the roll element, the at least one roll spring being adapted to rotate the roll element to the second position during the opening event, and wherein the control shaft is connected to the actuator by means of a free motion spring such that the control shaft is rotatable relative to the actuator between a rest position in which the free motion spring is in a low energy position, and an engagement position in which the free motion spring is in a tensioned position, the free motion spring being adapted to attempt to transfer the control shaft to the rest position if the control shaft is deflected therefrom.

* * * * *